United States Patent [19]

Pickett et al.

[11] 4,051,438

[45] Sept. 27, 1977

[54] CO-CHANNEL MULTIPLE SIGNAL BROADCASTING SYSTEM

[75] Inventors: Robert B. Pickett, Lompoc, Calif.; Elie J. Baghdady, Weston, Mass.

[73] Assignee: International Telephone and Telegraph Corporation, Nutley, N.J.

[21] Appl. No.: 612,391

[22] Filed: Sept. 11, 1975 (Under 37 CFR 1.47)

[51] Int. Cl.[2] ..... H04H 1/00

[52] U.S. Cl. ..... 325/45; 325/52; 343/200

[58] Field of Search ..... 325/32, 35, 36, 45, 325/46, 47, 50, 52, 145; 332/16, 18, 19; 179/15 FS, 15 BA

[56] References Cited

U.S. PATENT DOCUMENTS

| | | | |
|---|---|---|---|
| 2,989,622 | 6/1961 | Doherty | 325/50 |
| 3,109,991 | 11/1963 | Ocko | 325/46 |
| 3,258,694 | 6/1966 | Shepherd | 179/15 FS |
| 3,470,477 | 9/1969 | Battail et al. | 325/45 X |
| 3,714,577 | 1/1973 | Hayes | 325/145 |

*Primary Examiner*—Benedict V. Safourek

*Attorney, Agent, or Firm*—John T. O'Halloran; Alfred C. Hill

[57] ABSTRACT

Interference in the overlapping of at least two transmission transmitters areas of a co-channel multiple signal broadcasting system is suppressed by an asymmetrical radio frequency carrier deviation in one given direction of one of the two transmitters and an asymmetrical radio frequency carrier deviation in a direction opposite to the one given direction of the other of the two transmitters. The oppositely directed asymmetrical carrier deviations create a ± 2.5 kHz rms carrier frequency offset from the nominal carrier frequency in a manner which is compatible with present FCC regulations.

5 Claims, 7 Drawing Figures

CO-CHANNEL MULTIPLE SIGNAL BROADCASTING SYSTEM

BACKGROUND OF THE INVENTION

This invention relates to co-channel multiple signal broadcasting mobile communication system and more particularly to such a co-channel multiple signal broadcasting system with interference-free wide coverage.

Communication coverage over an extended geographical area such as is present in a mobile communication system can be achieved by using several transmitters to broadcast the same message on the same carrier or channel. This technique is finding acceptance in urban, suburban or country-wide areas where surface terrain preclude the use of a single transmitter. This simultaneous broadcasting, however, causes the communiction environment within the extended coverage area to be interference limited rather than front end noise limited.

Interference zones are created whenever overlap coverage exists, since two or more signals at nominally the same frequency may arrive at comparable amplitude levels, but with different modulation or group delays. The result can be interference that is similar to that produced in a multi-path environment. With the limied capture performance of commercial receivers the end result may well be that the extended area of coverage is interlaced with zones where the receive signal becomes unintelligible.

The reduction of the interference in overlap areas to tolerable levels is the problem solved by the present invention and which in the past has been solved by other techniques.

One of the prior art techniques to reduce distortion in overlap areas is the use of site selection, radiated power and directional antennas to minimize the size of overlap areas. This approach has only limited value since site selection is often dictated by convenience rather than RF (radio frequency) path suitability. In any case, minimizing overlap areas concurrently reduces the radio link safety margin within affected zones.

A second technique employed in the prior art to reduce distortion in overlap areas is to improve the receiver capture ratio. This can be accomplished by modifying commerical receivers or by manufacturing a new line of receivers with improved performance.

A third technique suggested in the prior art to reduce distortion in overlap areas is the use of a steerable antenna at the receiver sites. At present no commercial units with automatic steering are available for mobile applications.

A fourth technique employed in the prior art to reduce distortion in overlap areas synchronizes carrier frequencies and modulation phase delays in the overlap area. This technique has limited application in cities, mountainous terrain or in locations where transmitter spacing is more than 15 miles.

A fifth technique to reduce distortion in overlap areas separates the transmit carriers of the interfering transmitters on a static basis sufficiently to suppress the interference. This technique is known within the industry as "tertiary offset" and/or "territory offset". The problem with this technique is that more spectrum is required, FCC (Federal Communication Commission) regulations must be changed and wider bandwidth receivers are needed.

SUMMARY OF THE INVENTION

An object of the present invention is to suppress co-channel distortion or interference through carrier frequency separation, without a static offsetting of the carrier frequencies of the interfering transmitters.

Another object of the present invention is to provide the carrier frequency separation within present FCC channel bandwidth allocations and to conform to all existing FCC regulations.

Still another object of the present invention is the provision of a co-channel interference suppression system providing the benefits of the prior art frequency offset technique without actually statically separating the carrier frequencies or requiring wider channels.

A further object of the present invention is to provide a system for supressing co-channel interference that will operate with existing commerical receivers.

A feature of the present invention is the provision of a co-channel multiple signal broadcasting system to suppress co-channel interference in overlapping areas of transmission signals comprising: at least two angularly modulated transmitters disposed in spaced relation with respect to each other such that their respective transmission signals have at least one overlapping area, each of the two transmitters transmitting identical speech bursts by angularly modulating a carrier signal having a given carrier frequency; first means disposed in one of the two transmitters to deviate its associated carrier frequency in primarily a first given direction; and second means disposed in the other of the two transmitters to deviate its associated carrier frequency in primarily a second given direction opposite the first given direction; the opposite deviations of the carrier frequencies of the two transmitters providing an effective root mean square separation of the carrier frequencies of the two transmitters to suppress the co-channel interference.

Another feature of the present invention is the provision of a method of reducing co-channel interference in overlapping areas of transmission signals of a co-channel multiple signal broadcasting system comprising the step of: deviating a carrier frequency of a transmitter of the system by speech in primarily one given direction.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENTS

Figure 1:
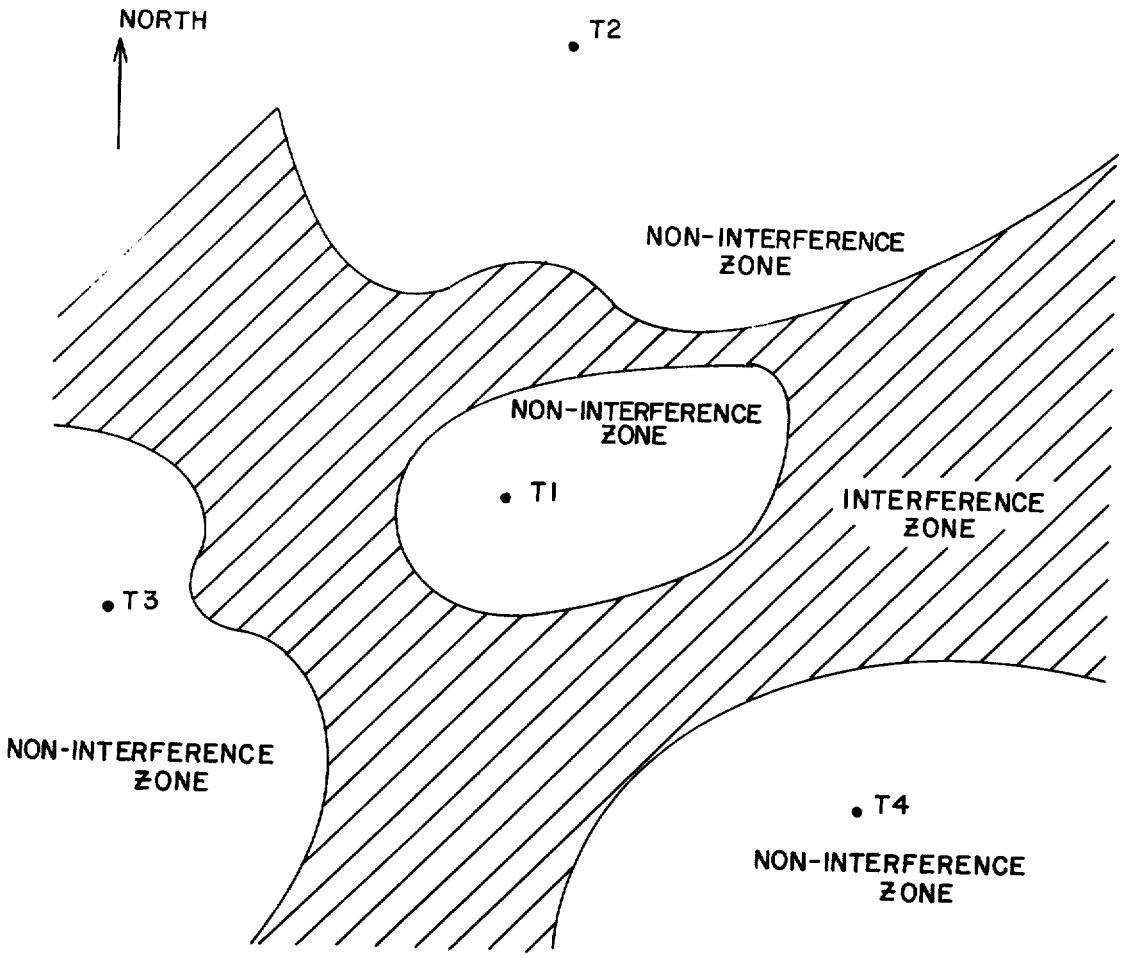
FIG. 1 is an illustration of a co-channel multiple signal broadcasting system illustrating the interference zone that is suppressed by the present invention.

Referring to FIG. 1 there is illustrated therein a co-:hannel multiple signal broadcast system with extended :overage being provided by transmitters T1-T4. Be-:ause of the long baselines between transmitters T2 and :3, transmitters T2 and T4 and transmitters T2 and T1, s well as an assumed rugged terrain, the technique of qualized modulation delay could not be utilized effec-ively.

Figure 3:
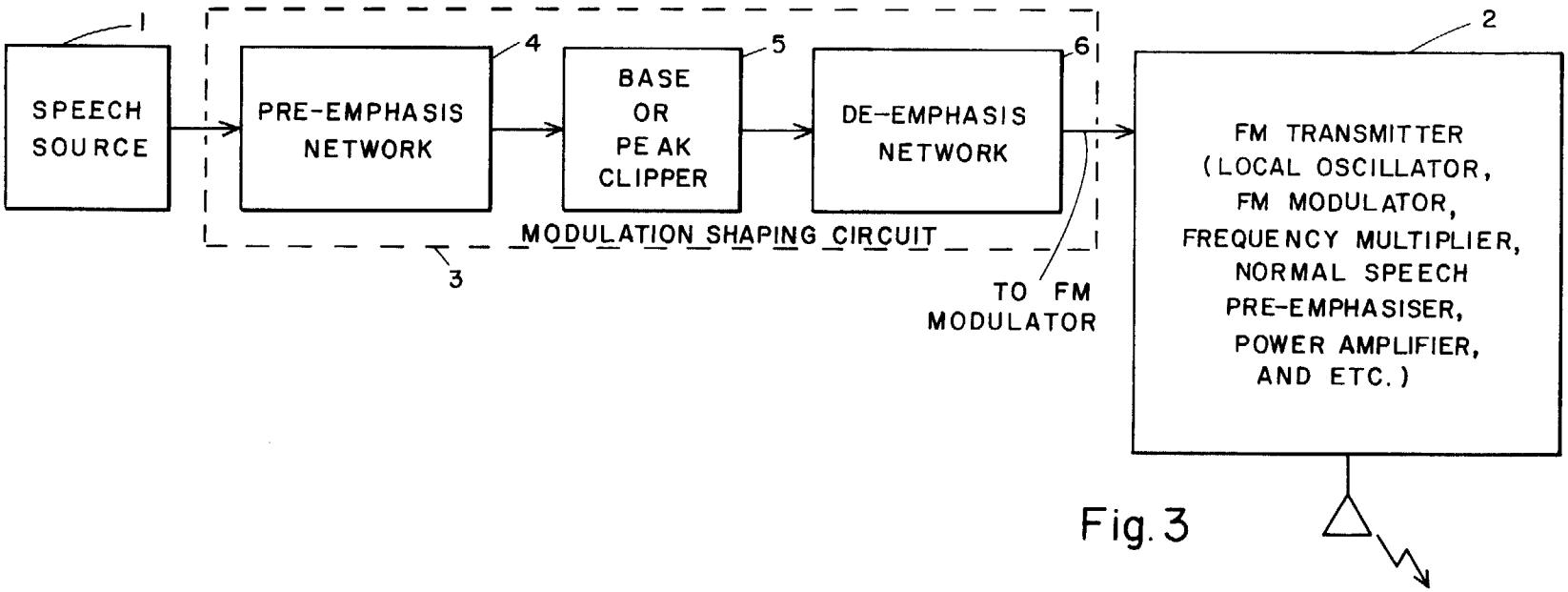
FIG. 3 is a block diagram of one embodiment of the interference suppressing system in accordance with the principles of the present invention.
Figure 7:
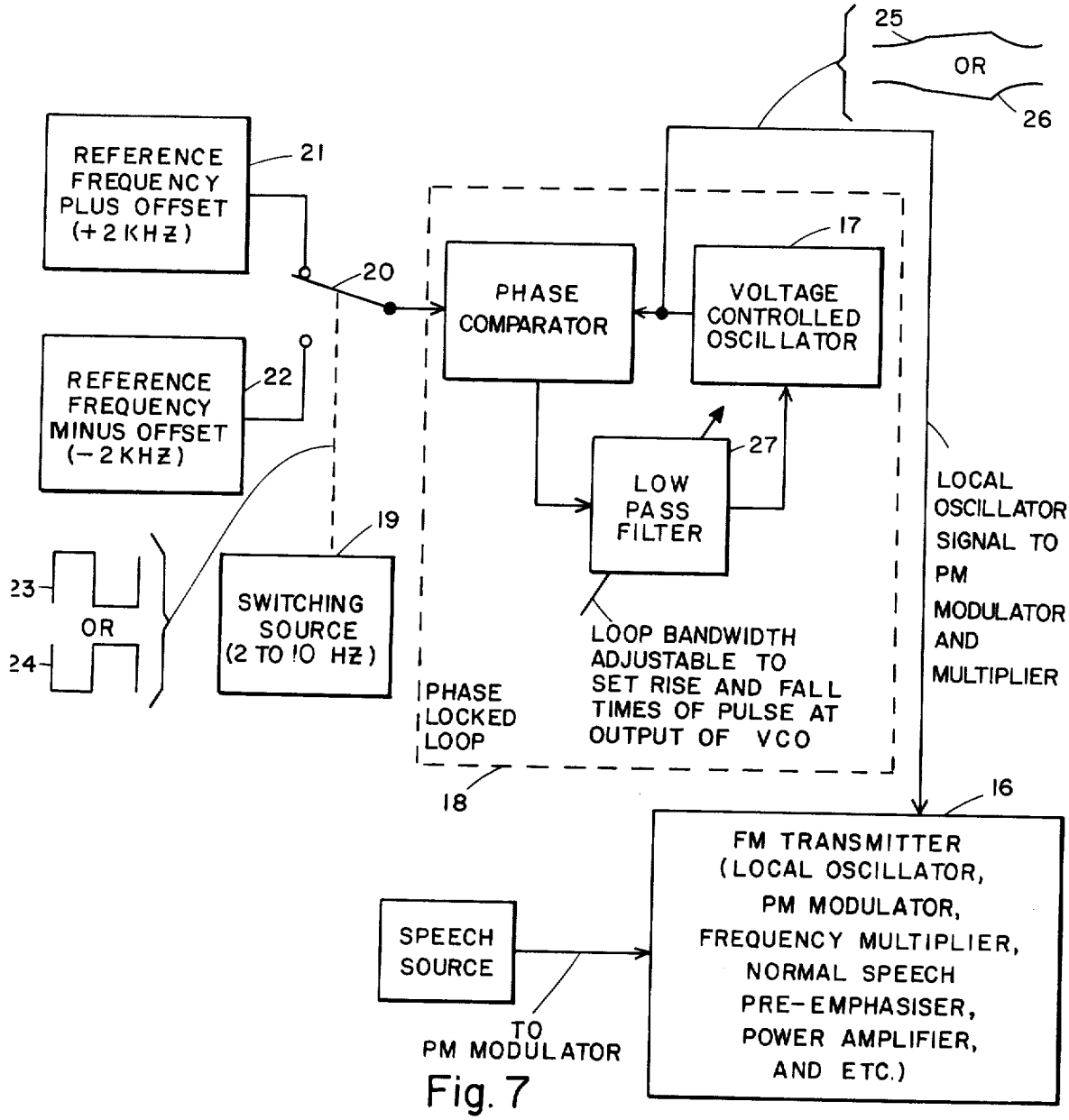
FIG. 7 is a block diagram of another embodiment of he interference suppressing system-in accordance with he principles of the present invention.

Either of the techniques of the present invention dis-:losed in FIGS. 3 and 7 will permit a suppression of nterference in the interference zone between transistors :2 and T3, transmitters T2 and T1, transmitters T3 and :4 and transmitters T1 and T4. To insure the suppres-ion of possible interference between transmitters T2 nd T4 a directional antenna at transmitter T4 was mployed to cover the southeast sector while greatly educing radiation in the northerly direction. The short aseline between transmitters T1 and T3, together with levated transmitters and relatively smooth terrain en-ble the use of modulation delay control at transmitter :1 to match the delay of transmitter T3. Therefore, by mploying the techniques disclosed herein and selected nes of the prior art techniques discussed hereinabove nder the heading "Background of the Invention", the uppression of distortion in all potentially troublesome reas of an extended multiple signal broadcasting sys-em is possible.

When using the technique disclosed in FIG. 7 of the resent application, local oscillator modulation with 'positive" synchronization was employed at transmit-ers T2 and T4 and "negative" synchronization was mployed at transmitters T1 and T3. To obtain the ynchronized local oscillator frequencies for the two ransmitters involved, two reference tones are inserted nto the order wire and/or signal channel of the micro-vave transmission systems linking the various transmis-ion sites. A phase locked loop is used at each site to onvert the necessary tone to the local oscillator signal vhich will be discussed hereinbelow with reference to FIG. 7. The reference tones received at each site are nodulated out of phase at a 2 to 10 Hz (hertz) rate to btain the required carrier frequency offset.

Figure 2:
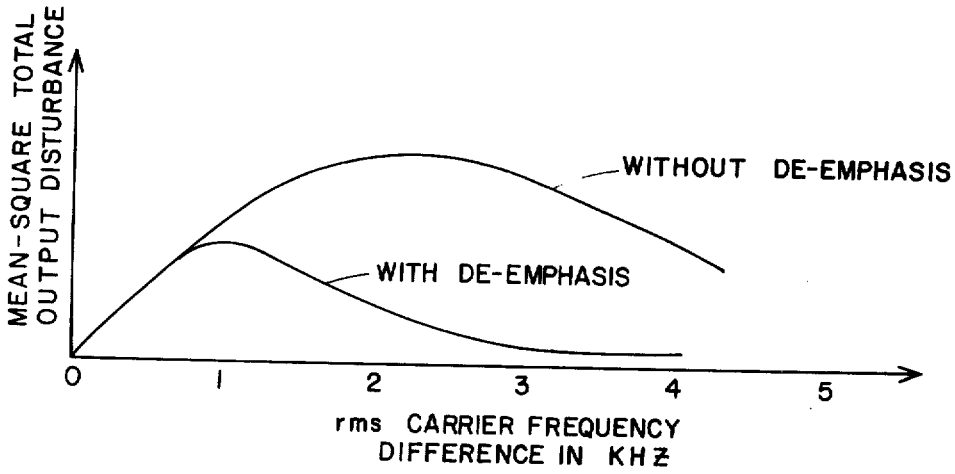
FIG. 2 is a set of curves illustrating the total output distortion caused by interference in the overlapping areas as a function of the rms (root mean square) frequency difference.

Referring to FIGS. 2 and 3 the precise difference of his invention from the known techniques outlined here-nabove under the leading "Background of the Inven-ion" are that the present invention uses the inherent urst characteristics of a speech waveform to provide n asymmetrical RF (radio frequency) carrier devia-ion.

Furthermore, the shaping of the speech waveform to ffect the asymmetrical deviation does not degrade the ntelligibility of the speech transmission even though listortion is introduced.

The allowable FCC carrier offset is ±1.15 kHz (kilo-ertz). This is not a wide enough separation to reduce listortion. The embodiment of FIG. 3 creates a ± 2.5 :Hz carrier frequency offset in a manner which is com-atible with present FCC regulations. The operation of he embodiment of FIG. 3 relies on a number of inter-cting phenomenon as follows: (1) Speech intelligibility s not sufficiently degraded by severe clipping as long as he zero crossings are retained. (2) Speech consists of short bursts followed by long pauses, in other words, speech has a low duty cycle. (3) In communication systems, the higher frequencies (above 2 kHz) are vital to intelligibility, yet are more severly masked by noise in the communication link. Hence, it is common practice in commercial equipment to pre-emphasize the high frequency at the transmitter and de-emphasize the high frequencies at the receiver. (4) As shown in FIG. 2, distortion caused by co-channel interference can be reduced to very small levels in commercial receivers using de-emphasis if the rms carrier separation is greater than 4 kHz. The key point of the present invention is rms carrier frequency separation, that is, it is not necessary to have a constant or static carrier frequency offset. This is the point that practitioners in the art have missed. The practitioners in the art use the technique of a constant or static offset of the carrier frequencies from the channel center (which required special FCC licensing) to obtain the carrier frequency separation.

This invention uses the burst properties of speech and/or special carrier modulation to obtain an effective rms carrier frequency separation exceeding 4.5 kHz. This technique is compatible with all FCC regulations.

The invention is based upon the fact that in normal speech, particularly in a two-way communication system, one of the communicating parties is normally quiet and listening about half the time and there are also many hesitations, pauses and other silent periods even when transmitting speech such as would occur in catching ones breath before saying the next phrase or sentence or during the thought pause of what the party will next say. This characteristic of speech is fully supported by the "Reference Data For Radio Engineers", Fifth Edition, Howard W. Sams and Co., Inc., a subsidiary of INTERNATIONAL TELEPHONE and TELEGRAPH CORPORATION, October 1968, pages 35 - 29 and 35 - 30. In addition, there are many patents in the art that indicate that certain communication systems such as a TASI (time assignement speech interpolation) system, where the prolonged periods of silence which occur in natural speech is utilized to transmit more channels of information. Examples of these patents are U.S. Pat. Nos. 3,513,260 (col. 1, lines 31 - 35); Re. 25,546 (col. 1, lines 21 - 25); 2,935,569 (col. 1, lines 21 - 25); 3,541,932 (col. 3, lines 5 - 15 ); 2,907,829 (col. 1, lines 19 - 22); and 2,957,946 (col. 1, lines 18 - 27).

Figure 4:
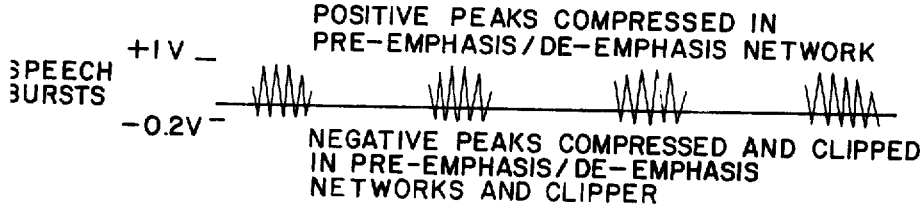
FIG. 4 is the waveform at the output of the de-emphasis network of FIG. 3 for one transmitter of two interfering transmitters.
Figure 5:
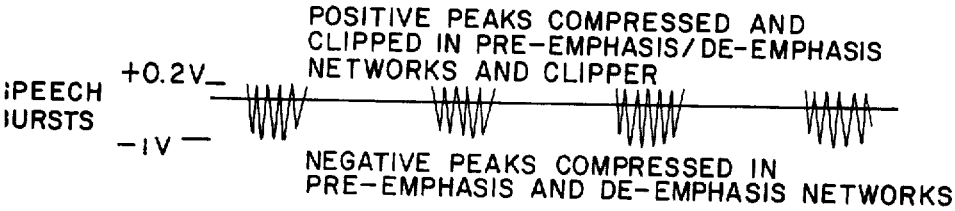
FIG. 5 is an illustration of the waveform at the output of the de-emphasis network oF FIG. 3 for the other transmitter of two interfering transmitters.

The embodiment of FIG. 3 operates as follows. Normal speech is provided by source 1 which normally would be connected directly to a known FM (frequency modulation) transmitter 2. However, according to the present invention the speech of source 1 is connected to a modulation shaping circuit 3 including pre-emphasis network 4 and clipper 5 which pre-emphasizes the high frequencies and asymmetrically compresses the speech waveform to give a one-sided speech wave train shown in FIG. 4. Clipper 5 in one transmitter of the two interfering transmitters is a base clipper and in the other transmitter of the two interfering transmitters is a peak clipper which would result in the waveform shown in FIG. 5. De-emphasis network 6 coupled to the output of clipper 5 returns the speech to its normal spectrum with the exception of distortion components produced by the compression. The speech output of network 6, although compressed, is not degraded in terms of intelligibility and is, therefore, connected to the input of transmitter 2 at the same peak level as normally employed.

Because speech consists of short bursts followed by long pauses, there is very little DC (direct current) baseline shift. Consequently, an FM transmitter carrier is deviated primarily in one direction from carrier center, that is, the carrier does not deviate back and forth about its center frequency symmetrically.

If negative peak compression (clipping) is employed at one transmitter of two interfering transmitters, and positive peak compression (clipping) is employed at the other transmitter of the two interfering transmitters, the carrier frequency of these two transmitters deviate in opposite directions, and, therefore, an rms carrier frequency separation results.

For commercial applications, that is, 25 kHz channels with 5 kHz peak deviation, an rms carrier frequency separation exceeding 4.5 kHz results during speech syllables as a result of the opposite carrier frequency deviations in the two interfering transmitters.

The compression has two side benefits. First, the peak carrier deviation is constant regardless of the input signal level. Thus, the receiver output level will remain constant for different speech levels, speech characteristics, etc. Secondly, for a given radiated power, intelligibility of the transmission is improved. This is because the signal-to-noise ratio is improved by over 6 db (decibel) by compression.

Figure 6:
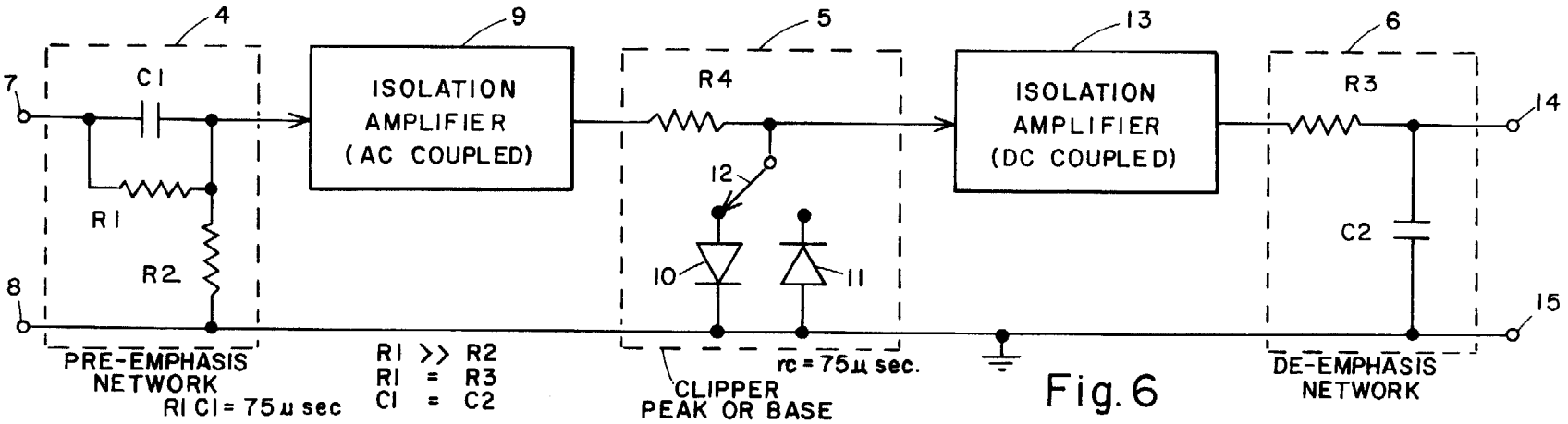
FIG. 6 is a schematic diagram of the pre-emphasis network, the base or peak clipper and the de-emphasis network of FIG. 3.

Referring to FIG. 6 there is illustrated therein the schematic diagram of pre-emphasis network 4, clipper 5 and de-emphasis network 6. Pre-emphasis network 4 includes capacitor C1 coupled to one of the input terminals 7 with the other input terminal 8 connected to a reference potential, such as ground. In parallel with capacitor C1 is a resistor R1 and resistor R2 is connected between the reference potential and the output terminal of capacitor C1. Resistor R1 has a value which is much greater than R2 and the time constant of the network is R1C1 = 75 microseconds. The output of pre-emphasis 4 is coupled to an AC (alternating current) coupled isolation amplifier 9 whose output is coupled to clipper 5. Clipper 5 includes resistor R4 and either of the two differently poled diodes 10 and 11 coupled between the output terminal of resistor R4 and the reference potential by switch 12. When diode 10 is in the circuit of clipper 5, base clipping takes place, that is, the negative peaks are clipped. When diode 11 is in the circuit of clipper 5, peak clipping takes place, that is, the positive peaks are clipped. The output of clipper 5 is coupled to DC coupled isolation amplifier 13 whose output is coupled to de-emphasis network 6 including resistor R3 in series with output terminal 4 and capacitor C2 across the output terminals 14 and 15. Keeping in mind that resistor R3 has a resistance value equal to the resistance value of resistor R1 and that capacitor C2 has a capacitatance value equal to the capacitance value of capacitor C1, the de-emphasis will have the same time constant as pre-emphasis network 4.

Referring to FIG. 7 there is disclosed a second embodiment capable of providing an rms carrier frequency separation without requiring a constant or static carrier frequency offset. In this embodiment the local oscillator signal for the known FM transmitter 16 is switched in one direction for one transmitter of two interfering transmitters and in the opposite for the other transmitter of the two interfering transmitters. The local oscillator signal produced by the voltage controlled oscillator 17 of the phase locked loop 18 is switched from 2 kHz above the nonimal frequency of oscilllator 17 to 2 kHz below the nominal frequency of oscillator 17 at a very slow switching rate controlled by source 19 through the switching arrangement 20 which is coupled to two sources of reference frequencies 21 and 22 having the appropriate offset value (2 kHz) above and below the nominal value of the oscillator output frequency. Thus, the local oscillator frequency is varied and is therefore useful for transmitters using derived FM obtained from a PM (phase modulation) modulator.

The switching source 19 produces a square wave output at a 2 to 10 Hz rate. In one transmitter of two interfering transmitters the output of source 19 would be as illustrated by waveform 23 while the source 19 in the other transmitter of two interfering transmitters would be 180° out of phase with the waveform 23 as shown by waveform 24. This 180° phase difference between the switching wave forms of source 19 provides a carrier separation maintained at 4 kHz except for the switching period. If the rise and fall time of the resulting waveforms 25 and 26 at the output of oscillator 17 is 0.01 seconds, the distortion which results endures for such a short time that it cannot be noticed. Waveform 25 occurs when switching waveform 23 is present from source 19 while waveform 26 occurs when the switching waveform from source 19 is waveform 24. The low pass filter 27 of the phase locked loop 18 is adjustable to enable an adjustment of the rise and fall time of the pulse at the output of oscillator 17.

It has been determined that by changing the local oscillator frequency ± 2 kHz from its nominal value at a subaudible rate is satisfactory for achieving the desired interference suppression in overlap areas. For example if the switching rate is set to 6 Hz with a 0.01 second rise and fall time; if the switching times are synchronized within ± 5 milliseconds so that the carrier frequency of one interfering transmitter is at $(f_c + 2)$ kHz while the carrier frequency of the second interfering transmitter is at a $(f_c - 2)$ kHz and vice versa; and if the time delay difference is limited to ± 5 milliseconds (1000 miles); then the maximum time interval during which the interference will be received at the same frequency is 0.02 seconds. Distortion which results in this short time interference is not noticeable and will not mask a word or syllable. The synchronization of switching times mentioned hereinabove can be accomplished in a manner similar to that described with respect to FIG. 1.

While we have described above the principles of our invention in connection with specific apparatus it is to be clearly understood that this description is made only by way of example and not as a limitation to the scope of our invention as set forth in the objects thereof and in the accompanying claims.

We claim:

1. A co-channel multiple signal broadcasting system to suppress co-channel interference in overlapping areas of transmission signals comprising:

at least two angularly modulated transmitters disposed in spaced relation with respect to each other such that their respective transmission signals have at least one overlapping area, each of said two transmitters transmitting identical speech bursts by angularly modulating a carrier signal having a given carrier frequency;

first means disposed in one of said two transmitters to deviate its associated carrier frequency in primarily a first given direction; and second means disposed in the other of said two transmitters to deviate its associated carrier frequency in primarily a second given direction opposite said first given direction;

the opposite deviations of said carrier frequencies of said two transmitters providing an effective root mean square separation of said carrier frequencies of said two transmitters to suppress said co-channel interference;

said first means including a first source of said identical speech bursts, a first pre-emphasis network coupled to said first source, a base clipper coupled to said first pre-emphasis network, and a first de-emphasis network coupled to said base clipper; and said second means including a second source of said identical speech bursts, a second pre-emphasis network coupled to said second source, a peak clipper coupled to said second pre-emphasis network, and a second de-emphasis network coupled to said peak clipper.

2. A co-channel multiple signal broadcasting system to suppress co-channel interference in overlapping areas of transmission signals comprising:

at least two angularly modulated transmitters disposed in spaced relation with respect to each other such that their respective transmission signals have at least one overlapping area, each of said two transmitters transmitting identical speech bursts by angularly modulating a carrier signal having a given carrier frequency;

first means disposed in one of said two transmitters to deviate its associated carrier frequency in primarily a first given direction; and second means disposed in the other of said two transmitters to deviate its associated carrier frequency in primarily a second given direction opposite said first given direction;

the opposite deviations of said carrier frequencies of said two transmitters providing an effective root means square separation of said carrier frequencies of said two transmitters to suppress said co-channel interference;

said first means including a source of said identical speech bursts, a pre-emphasis network coupled to said source, a clipper coupled to said pre-emphasis network to clip one of the peaks of said identical speech bursts, and a de-emphasis network coupled to said clipper.

3. A co-channel multiple signal broadcasting system to suppress co-channel interference in overlapping areas of transmission signals comprising:

at least two angularly modulated transmitters disposed in spaced relation with respect to each other such that their respective transmission signals have at least one overlapping area, each of said two transmitters transmitting identical speech bursts by angularly modulating a carrier signal having a given carrier frequency;

first means disposed in one of said two transmitters to deviate its associated carrier frequency in primarily a first given direction; and second means disposed in the other of said two transmitters to deviate its associated carrier frequency in primarily a second given direction opposite said first given direction;

the opposite deviations of said carrier frequencies of said two transmitters providing an effective root means square separation of said carrier frequencies of said two transmitters to suppress said co-channel interference;

said second means including a source of said identical speech bursts, a pre-emphasis network coupled to said source, a clipper coupled to said pre-emphasis network to clip one of the peaks of said identical speech bursts, and a de-emphasis network coupled to said clipper.

4. A co-channel multiple signal broadcasting system to suppress co-channel interference in overlapping areas of transmission signals comprising:

at least two angularly modulated transmitters disposed in spaced relation with respect to each other such that their respective transmission signals have at least one overlapping area, each of said two transmitters transmitting identical speech bursts by angularly modulating a carrier signal having a given carrier frequency;

first means disposed in one of said two transmitters to deviate its associated carrier frequency in primarily a first given direction; and second means disposed in the other of said two transmitters to deviate its associated carrier frequency in primarily a second given direction opposite said first given direction;

the opposite deviations of said carrier frequencies of said two transmitters providing an effective root mean square separation of said carrier frequencies of said two transmitters to suppress said co-channel interference;

said first means including a first source of said identical speech bursts, a first reference potential, a first capacitor having one terminal thereof coupled to said first source, a first resistor coupled in parallel to said first capacitor from said one terminal of said first capacitor to the other terminal of said first capacitor, a second resistor coupled from said other terminal of said first capacitor to said first reference potential, a first AC coupled isolation amplifier having an output and an input coupled to said other terminal of said first capacitor, a third resistor having one terminal thereof coupled to said output of said first AC coupled amplifier, a first diode coupled between said first reference potential and the other terminal of said third resistor, said first diode being poled to clip the negative peaks of said identical speech bursts, a first DC coupled isolation amplifier having an output and an input coupled to said other terminal of said third resistor, a fourth resistor having one of its terminals coupled to said output of said first DC coupled amplifier, and a second capacitor coupled between said first reference potential and the other terminal of said fourth resistor, said other terminal of said fourth resistor being the output terminal of said first means; and said second means including a second source of said identical speech bursts, a second reference potential, a third capacitor having one terminal thereof coupled to said second source, a fifth resistor coupled in parallel to said third capacitor from said one terminal of said third capacitor to the other terminal of said third capacitor, a sixth resistor coupled from said other terminal of said third capacitor to said second reference potential, a second AC coupled isolation amplifier having an output and an input coupled to said other terminal of said third capacitor, a seventh resistor having one terminal thereof coupled to said output of said second AC coupled amplifier, a second diode coupled between said second reference potential and the other terminal of said seventh resistor, said second diode being poled to clip the positive peaks of said identical speech bursts, a second DC coupled isolation amplifier having an output and an input coupled to said other terminal of said seventh resistor, an eighth resistor having one of its terminals coupled to said output of said second DC coupled amplifier, and a fourth capacitor coupled between said second reference potential and the other terminal of said eighth resistor, said other terminal of said eighth resistor being the output terminal of said second means.

5. A co-channel multiple signal broadcasting system to suppress co-channel interference in overlapping areas of transmission signals comprising:

at least two angularly modulated transmitters disposed in spaced relation with respect to each other such that their respective transmission signals have at least one overlapping area, each of said two transmitters transmitting identical speech bursts by angularly modulating a carrier signal having a given carrier frequency;

first means disposed in one of said two transmitters to deviate its associated carrier frequency in primarily a first given direction; and second means disposed in the other of said two transmitters to deviate its associated carrier frequency in primarily a second given direction opposite said first given direction;

the opposite deviations of said carrier frequencies of said two transmitters providing an effective root means square separation of said carrier frequencies of said two transmitters to suppress said co-channel interference;

said first means including a source of said identical speech bursts, a reference potential, a first capacitor having one terminal thereof coupled to said source, a first resistor coupled in parallel to said first capacitor from said one terminal of said first capacitor to the other terminal of said first capacitor, a second resistor coupled from said other terminal of said first capacitor to said reference potential, an AC coupled isolation amplifier having an output and an input coupled to said other terminal of said first capacitor, a third resistor having one terminal thereof coupled to said output of said AC coupled amplifier, a diode coupled between said reference potential and the other terminal of said third resistor, said diode being poled to clip the negative peaks of said identical speech bursts, a DC coupled isolation amplifier having an output and an input coupled to said other terminal of said third resistor, a fourth resistor having one of its terminals coupled to said output of said DC coupled amplifier, and a second capacitor coupled between said reference potential and the other terminal of said fourth resistor, said other terminal of said fourth resistor being the output terminal of said first means.

* * * * *